US006580042B1

(12) United States Patent
Miller et al.

(10) Patent No.: US 6,580,042 B1
(45) Date of Patent: Jun. 17, 2003

(54) CIRCUIT BOARD INTEGRATED PRESSURE SWITCH

(75) Inventors: Brian L. Miller, Knoxville, TN (US); Dorothy H. J. Miller, Knoxville, TN (US)

(73) Assignee: Xilor, Inc., Knoxville, TN (US)

( * ) Notice: Subject to any disclaimer, the term of this patent is extended or adjusted under 35 U.S.C. 154(b) by 0 days.

(21) Appl. No.: 10/096,566

(22) Filed: Mar. 13, 2002

(51) Int. Cl.[7] ..... H01H 35/40
(52) U.S. Cl. ..... 200/83 R; 200/83 B
(58) Field of Search ..... 200/83 A, 83 R, 200/81 R, 83 N, 83 P, 83 S, 83 SA, 83 B

(56) References Cited

U.S. PATENT DOCUMENTS 5,619,022 A * 4/1997 Long ..... 200/83 P
5,708,245 A * 1/1998 Werner et al. ..... 200/83 P

* cited by examiner

*Primary Examiner*—Elvin Enad
*Assistant Examiner*—Marina Fishman
(74) *Attorney, Agent, or Firm*—Pitts & Brittian, P.C.

(57) ABSTRACT

A pressure switch integrated onto an electronic circuit board for sensing when the ambient pressure reaches a specified value. The pressure switch is low profile, reliable and has a set point that can be configured at, or after, the time of installation of the associated circuit board. Further, the pressure switch can contain other electrical components to conserve valuable circuit board real estate and allow the construction of a rugged, protective self-contained electronic pressure switch.

21 Claims, 7 Drawing Sheets

CIRCUIT BOARD INTEGRATED PRESSURE SWITCH

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Scope of Invention

This invention relates to the field of pressure switches. More specifically, the present invention relates to a circuit board integrated pressure switch that can be calibrated to a desired set point at the time of assembly or after assembly.

2. Description of the Related Art

Pressure switches are known to those skilled in art. Typically, these devices fall into two categories. In the first category are set-point pressure switches that actuate when a specified pressure is reached. The second category contains the more sophisticated pressure measuring switches that are capable of measuring the ambient pressure and reacting accordingly. Generally, the pressure switches in the first category are less complex and more cost efficient than those in the second category.

In low tire pressure warning systems, a typical mass-market application, the critical function of the warning system is to identify when the tire pressure falls below a specified value. Accordingly, using a pressure sensor with the ability to measure the tire pressure adds extra expense to the system.

FIG. 1 illustrates an exploded view of a conventional pressure switch. The conventional pressure switch includes a base member 11 having tabs 12 for securing the conventional pressure switch on a circuit board. Connected to the base member 11 is a metal enclosure 13. A hollow contact pin 14 passes through an opening in the base of the metal enclosure 13 and allows the pressure of and/or the gas within the pressure switch to be changed. A non-conductive end piece 15 serving as a diaphragm support is attached to the end of the contact pin 14 terminating within the metal enclosure 13. A thin metal diaphragm 17 covers the open end of the metal enclosure 13. A metal spring 16 biases the end piece 15 and the contact pin 14 against the diaphragm 17. The metal spring 16, in combination with the hollow contact pin 14, is selected to set the pressure at which the switch responds. A cover 18 having a small, central through opening 19 provides protection for the diaphragm 17.

BRIEF SUMMARY OF THE INVENTION

An apparatus integrated onto an electronic circuit board for sensing when the ambient pressure reaches a specified value, or pressure switch, is shown and described. The pressure switch is low profile, reliable and has a set point that can be configured at, or after, the time of installation of the associated circuit board. Further, the pressure switch can contain other electrical components to conserve valuable circuit board real estate and allow the construction of self-contained electronic pressure switches.

The pressure switch is an absolute pressure switch including a fluid-tight sealed enclosure having one surface that acts as a diaphragm. At least one other surface of the pressure switch is formed from a circuit board. The internal volume of the pressure switch is typically small and is maintained at the atmospheric pressure where and when the pressure switch is sealed. Variations in the ambient air pressure relative to the internal pressure force the diaphragm to move thereby making or breaking contact with an electrical conductor that completes the switch. Finally, the internal volume can be filled with either atmospheric gases or with an inert gas selected to prevent oxidation or to change the set point characteristics.

In one embodiment, the pressure switch includes a number of rings stacked on the surface of the circuit board to create an open-ended enclosure having the desired volume. In the illustrated embodiment, the enclosure is a cylinder with the circuit board forming the base of the cylinder. In another embodiment, the enclosure of the pressure switch is formed using the thickness of the circuit board. In this embodiment, the circuit board defines a large diameter plated through opening. A trace is etched around the edges of the through opening to cooperate with the solder paste to provide the sealing function. A base plate is secured to one side of the circuit board. The base plate defines a contact opening adapted to receive a conductive member. The end of the conductive member is positioned at a distance relative to or in contact with the diaphragm while the pressure switch is under pressure to define the appropriate set point. The conductive member is secured in a fluid-manner, e.g., soldered into place.

The diaphragm is secured to the open end of the enclosure in a fluid-tight manner, completing the sealed enclosure. The diaphragm is constructed from an electrically conductive, flexible material. The diaphragm includes a series of concentric grooves to provide extra flexibility such that the diaphragm can move without deformation. Both the top and bottom surfaces of the diaphragm are provided with a set of concentric grooves. Within each set, the concentric grooves are equally spaced; however, the top set and the bottom set are offset from one another. The present inventors have found that this arrangement provides increased flexibility and responsiveness in the diaphragm. The diaphragm is designed to exhibit flexibility and allow movement in response to a pressure differential between the ambient pressure and the internal air pressure of the pressure switch.

The circuit board defines a through opening providing access to the interior of the enclosure. The through opening is dimensioned to receive a conductive member that serves to define the set point of the pressure switch. The conductive member is secured within the through opening in a fluid-tight manner, e.g., soldered into place. To assign a set point, the pressure switch is placed under pressure. Typically this is achieved by applying a calibrated pressure on the diaphragm to induce movement. The conductive member is installed through the through opening in the bottom of the volume until it is brought in contact with the distended bottom surface of the diaphragm and soldered into place to create a fluid-tight seal. When pressure is released, the diaphragm returns to an unflexed position thereby placing the pressure switch into its normal state. Depending upon the application, the pressure switch can be configured to react when the ambient pressure either goes above or below a selected set-point.

BRIEF DESCRIPTION OF THE SEVERAL VIEWS OF THE DRAWINGS

The above-mentioned features of the present invention will become more clearly understood from the following detailed description of the invention read together with the drawings in which.

DETAILED DESCRIPTION OF THE INVENTION

An apparatus integrated onto an electronic circuit board for sensing when the ambient pressure reaches a specified value, or pressure switch, is described and shown generally at 10 in the figures. The pressure switch 10 is low profile, reliable and has a set point that can be configured at, or after, the time of installation of the associated circuit board. Further, the pressure switch 10 can contain other electrical components to conserve valuable circuit board real estate and allow the construction of self-contained electronic pressure switches.

Figure 1:
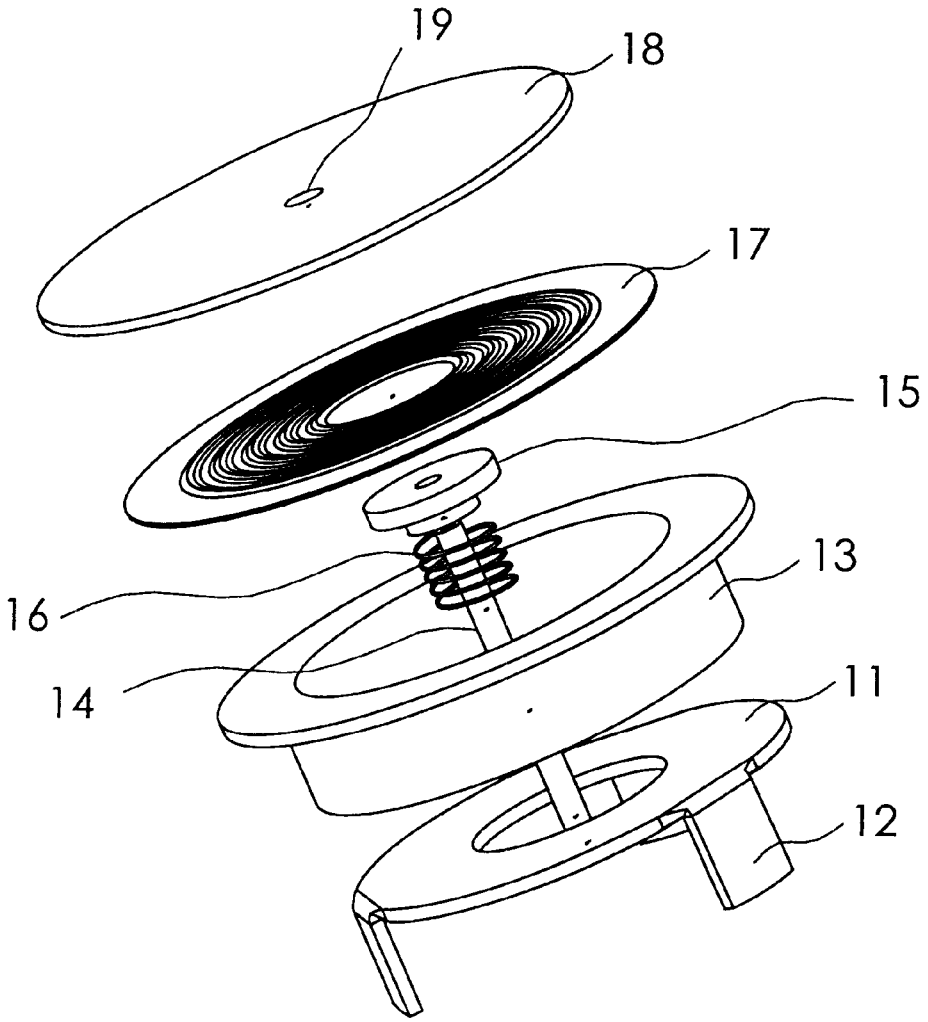
Fig. 1 (Prior Art)
FIG. 1 illustrates a conventional pressure switch according to the prior art.
Figure 2:
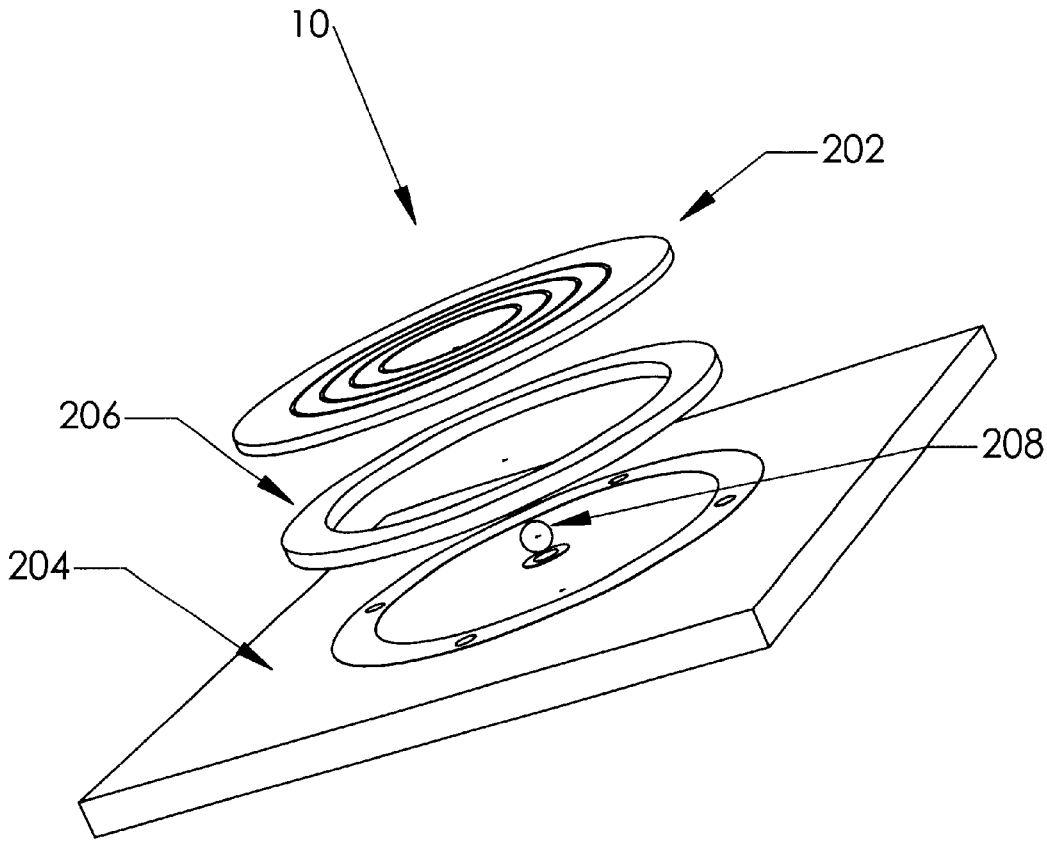
FIG. 2 illustrates a circuit board including a pressure switch according to the present invention.

FIG. 2 illustrates a circuit board integrated pressure switch 10 of the present invention. The pressure switch 10 is an absolute pressure switch including a fluid-tight sealed enclosure having one surface that acts as a diaphragm 202. At least one other surface of the pressure switch is formed from a circuit board 204. In the illustrated embodiment, the enclosure is built using a spacer ring 206. The internal volume of the pressure switch 10 is typically small and is maintained at the atmospheric pressure where and when the pressure switch 10 is sealed. Variations in the ambient air pressure flex the diaphragm 202 thereby making or breaking contact with an electrically conductive member 208 that completes the pressure switch 10. In the illustrated embodiment, the conductive member 208 is a ball bearing.

Figure 3:
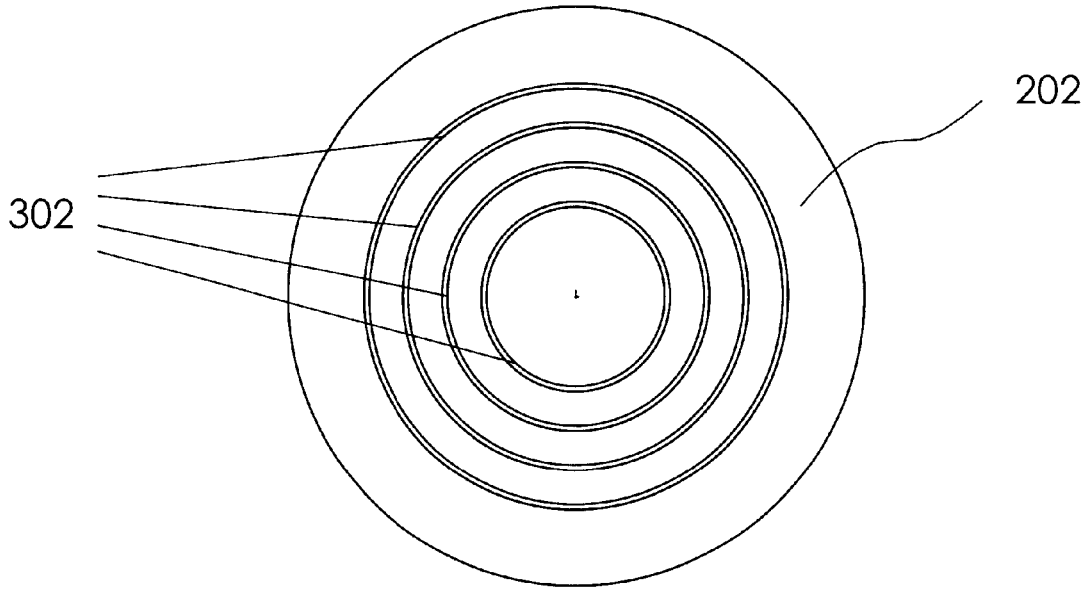
FIG. 3 is a top plan view of a diaphragm of the pressure switch of the present invention.

FIG. 3 illustrates a top plan view of the diaphragm 202. The diaphragm 202 is constructed from an electrically conductive, flexible material, such as a spring temper metal, i.e., phosphorous bronze. In the illustrated embodiment, the diaphragm 202 has a circular shape. Those skilled in the art will recognize that the diaphragm can be constructed from other materials exhibiting the desired flexibility and could have other shapes without departing from the spirit and scope of the present invention. The diaphragm 202 includes a series of concentric grooves 302 to provide extra flexibility such that the diaphragm can move without deformation. One method of creating the grooves 302 is by chemically etching the diaphragm. Those skilled in the art will recognize that other methods of creating the grooves 302, including stamping and other machining techniques, can be used without departing from the spirit and scope of the present invention.

Figure 4:
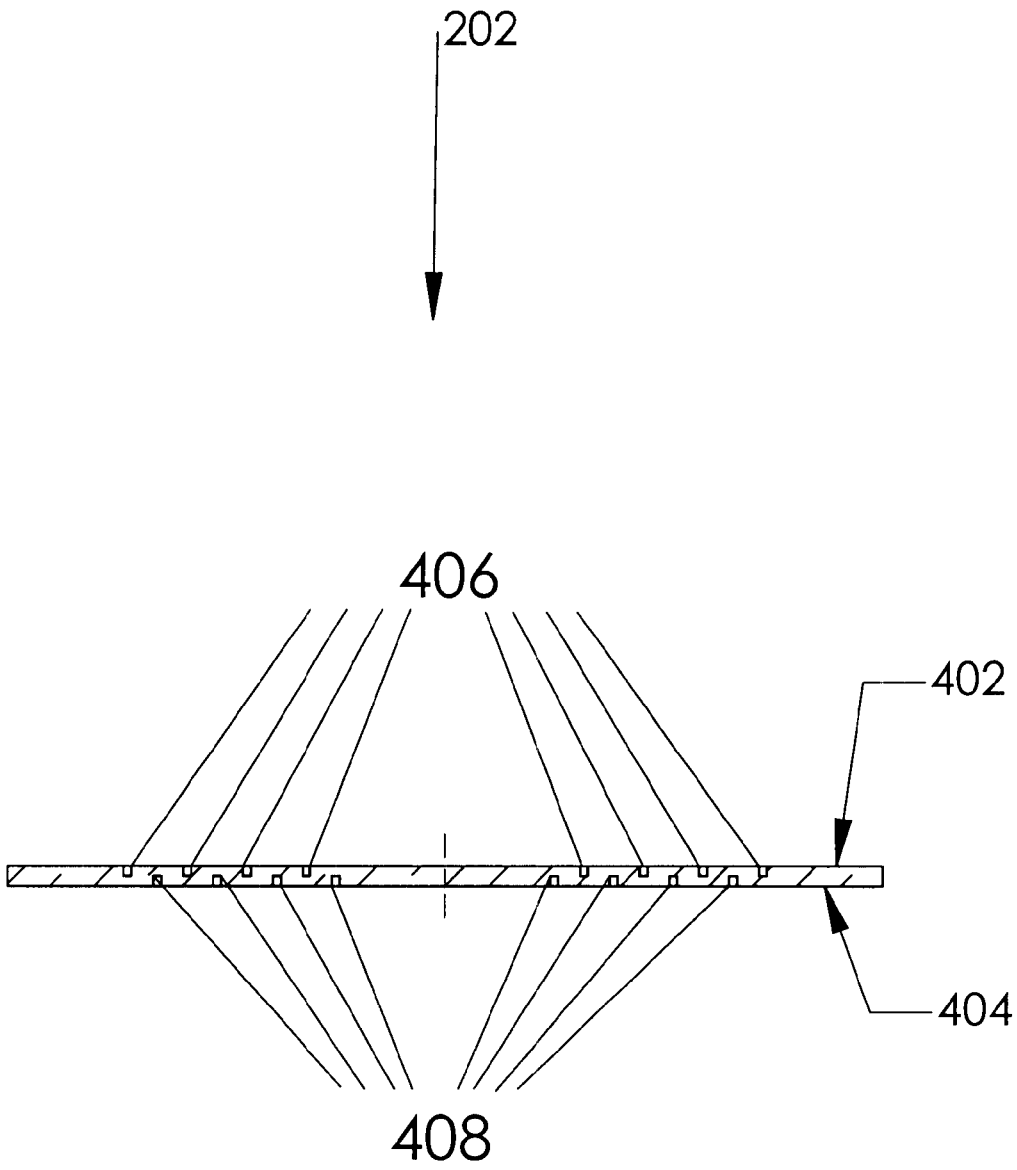
FIG. 4 is a sectional view of the diaphragm of FIG. 3.

FIG. 4 illustrates a cross-section of the diaphragm 202 shown in FIG. 3. In the illustrated embodiment, both the top 402 and bottom surface 404 of the diaphragm are provided with a set of concentric grooves 406, 408. Within each set 406, 408, the concentric grooves are equally spaced; however, the top set 406 and the bottom set 408 are offset from one another. The present inventors have found that this arrangement provides increased flexibility and responsiveness in the diaphragm 202. In the illustrated embodiment, the top set 406 and the bottom set 408 are offset by one-half of the groove spacing. Those skilled in the art will recognize that other groove patterns, groove spacings, and groove offsets can be used without departing from the spirit and scope of the present invention. The diaphragm 202 is designed to exhibit flexibility and allow movement in response to a pressure differential between the ambient pressure and the internal air pressure of the pressure switch 10.

Figure 5:
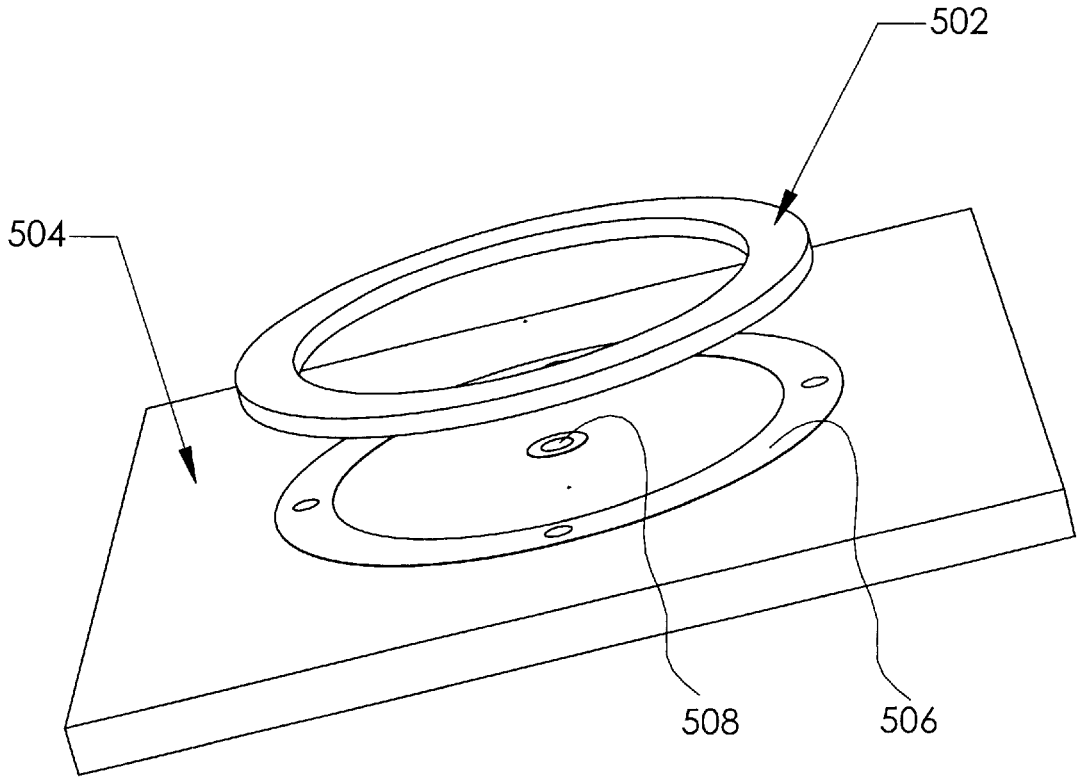
FIG. 5 illustrates, in partial section, one embodiment of the pressure switch of the present invention.

FIG. 5 illustrates one embodiment in which the pressure switch 10 includes at least one ring 502 stacked on the surface of the circuit board 504 to create an open-ended enclosure having the desired volume. In the illustrated embodiment, the enclosure is a cylinder with the circuit board forming the base of the enclosure. A trace 506 matching the shape of the enclosure is printed on the circuit board to define the enclosure position. The material from which the rings 502 are formed is not critical; however, the rings 502 are typically solid metal or metal laminated. A solder paste coating on the rings 502 provides the sealing mechanism when heated and serves to form a gas-impermeable barrier when semi-porous materials are used. The solder paste-coated rings 502 are permanently seated on the circuit board 504 by placing the circuit board in a reflow oven. The present inventors have found that the rings 502 substantially align as the solder paste flows during heating and that no special alignment effort is necessary to achieve a sealed enclosure. Those skilled in the art will recognize that, while rings 502 and a generally cylindrical enclosure are described herein, other shapes may be used without departing from the scope and spirit of the present invention. The diaphragm serves as the top of the enclosure and provides the pressure-sensitive switching function.

The circuit board defines a through opening 508 providing access to the interior of the enclosure. The through opening 508 is dimensioned to receive a conductive member that serves to define the set point of the pressure switch. It is desirable, but not necessary, for the conductive member to be constructed from the same metal as the diaphragm. This reduces the effect of galvanic corrosion. In addition, those skilled in the art will recognize that the electric connection can be maximized by increasing the contact geometry between the conductive member and the diaphragm. One method of achieving the increased contact area when using an elongated conductive member is to shear the contact end of the member such that it presents a flat surface normal to the diaphragm.

Figure 6:
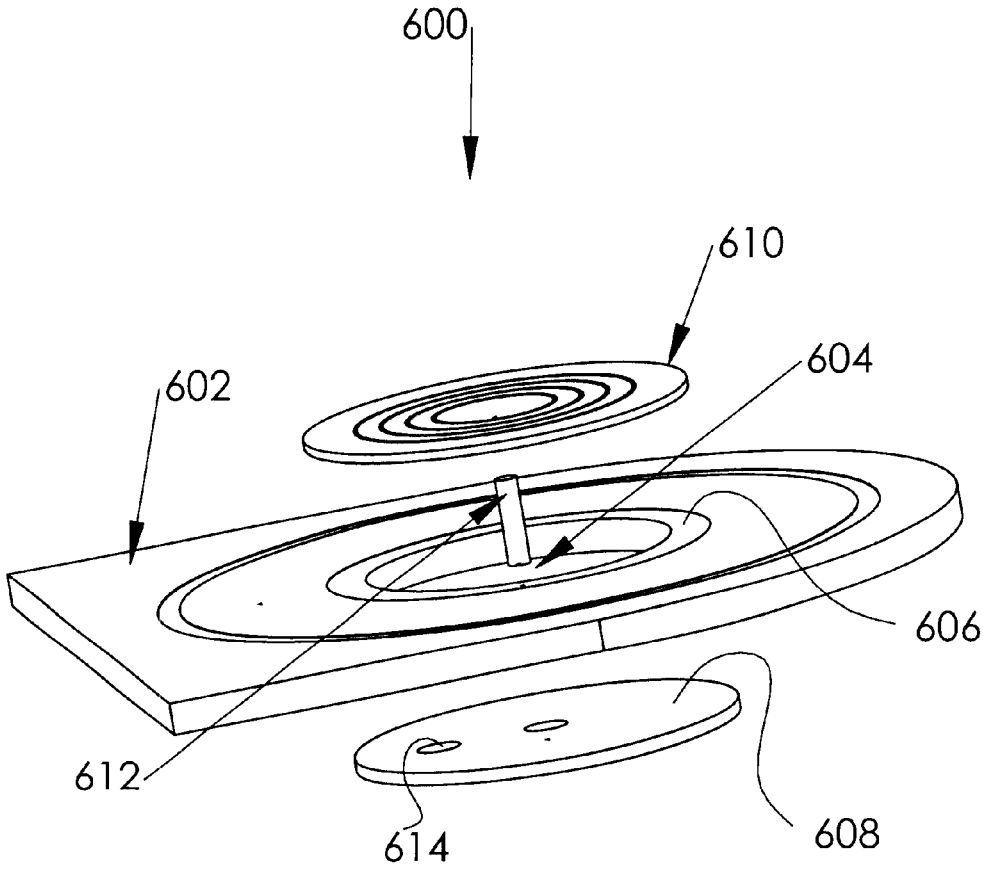
FIG. 6 illustrates, in partial section, an, alternate embodiment of the pressure switch of the present invention.

In another embodiment, illustrated in FIG. 6, the enclosure of the pressure switch 600 is formed using the thickness of the circuit board 602. In this embodiment, the circuit board 602 defines a large diameter through opening 604. A trace 606 is etched around the edges of the through opening 604 which cooperates with the solder paste to provide the sealing function. A base plate 608 is secured to one side of the circuit board 602 and a diaphragm 610 is secured to the opposite side of the circuit board 602 to seal the through opening 604 in a fluid-tight manner. The base plate 608 defines a contact opening adapted to receive a conductive member 612. The end of the conductive member 612 is positioned at a distance relative to or in contact with the diaphragm 610 while the pressure switch 600 is under pressure to define the appropriate set point. The conductive member 612 is secured in a fluid-tight manner, e.g., soldered into place.

The embodiment of FIG. 6 further defines a separate pressure valve opening 614. The pressure valve opening 614 is used to establish the internal pressure of the pressure switch and to facilitate the exchange of gases within the pressure switch. For many applications, the pressure switch 600 can operate using standard atmospheric gases; however, those skilled in the art will recognize that the internal volume of the pressure switch 600 can be filled with an inert gas to prevent oxidation. The pressure valve opening 614 facilitates changes to the internal pressure or fill gas that are independent of the positioning of the conductive member 612. Once the desired internal pressure or internal gas is established, the pressure valve opening 614 is sealed in a fluid-tight manner. Those skilled in the art will recognize that the pressure valve opening 614 can be closed in a permanent manner, preventing later modifications, or temporary manner, facilitating later modifications, without departing from the spirit and scope of the present invention. Further, those skilled in the art will recognize that the features provided by the pressure valve opening 614 can be achieved using the contact opening, thereby obviating the need for multiple fluid-tight seals to be maintained.

In the embodiment illustrated in FIG. 6, the conductive member is an elongated member such as a wire or pin. To assign a set point, the pressure switch is placed under pressure. Typically this is achieved by applying a calibrated pressure on the diaphragm to induce movement. The conductive member is then inserted through the through opening in the bottom of the volume until it is brought in contact with the distended bottom surface of the diaphragm and soldered into place to create a fluid-tight seal. When pressure is released, the diaphragm returns to an unflexed position thereby placing the pressure switch into its normal state. Depending upon the application, the pressure switch can be configured to react when the ambient pressure either goes above or below a selected set point. For example, in the application of a low tire pressure warning system, the pressure switch is set at the desired warning pressure. While the tire pressure exceeds the set point of the pressure switch, i.e., a positive pressure differential, the pressure switch remains closed. As the tire pressure decreases and approaches the warning pressure, the diaphragm of the pressure switch deflects outwardly in response to the lowering of the ambient pressure. In this condition, the pressure switch opens signaling that the tire pressure is low. Conversely, in an application that requires monitoring of an increase in the ambient air pressure above a particular set point, the pressure switch is higher and the switch remains normally open. When the ambient air pressure equals or exceeds the set point pressure, the diaphragm deflects inwardly and the pressure switch closes.

In an alternate embodiment, such as illustrated in FIG. 2, the conductive member is a precision ball bearing ground to specification. The set point of the pressure switch is adjusted without the need to apply an external pressure to the pressure switch. Specifically, the set point is adjusted by selecting a bearing of a desired diameter which corresponds to a set point for a pressure switch of particular dimensions. The bearing is sealed in the through opening of the enclosure. Alternately, the diameter of the bearing can remain constant and the diameter of the enclosure through opening can be varied to change the height at which the bearing sits relative to the diaphragm. The use of a bearing for the conductive member simplifies final assembly of the pressure switch. Further, if the diameter of the through opening is used as the set point variable, the required assembly inventory is minimized.

Figure 7:
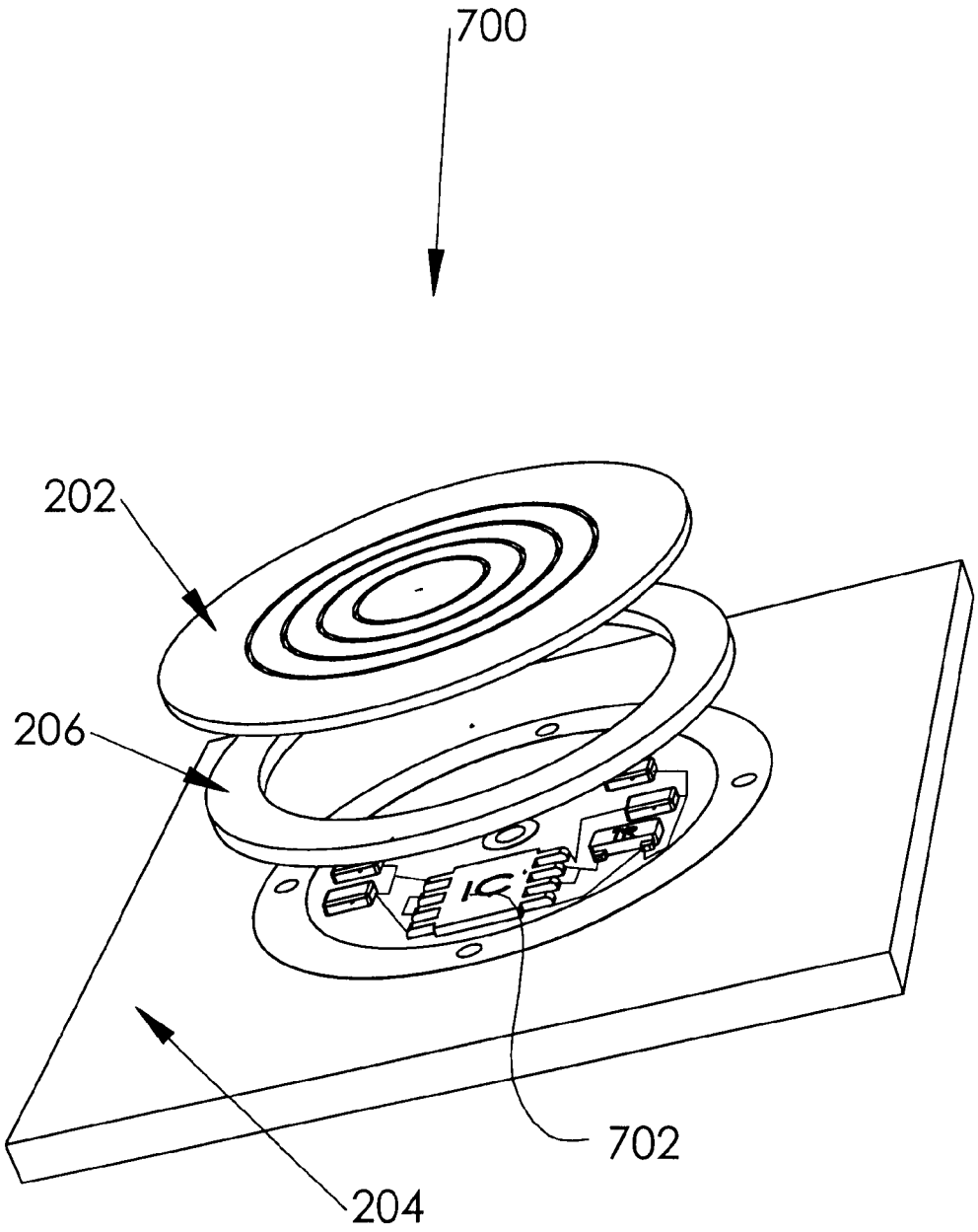
FIG. 7 illustrates a pressure switch of the present invention including internal circuitry.

FIG. 7 illustrates an exploded view of an alternate embodiment of the pressure switch 700 including internal circuitry 702 not necessarily related to the operation of the pressure switch 700. The components and traces that are disposed within the volume of the enclosure do not interfere with the operation of the pressure switch. Accordingly, by locating components and traces on the circuit board real estate internal to the enclosure of the pressure switch, miniaturization and protection of the circuit is realized.

In another embodiment, two pressure switches according to the present invention can be disposed back-to-back to provide a range over which the pressure switch operates. Typically, such an arrangement would involve a multi-layer circuit board with a central conductor. Two opposing enclosures would be formed each having its own contact member, and diaphragm. By configuring the dual pressure switch with two set points, the pressure switch effectively operates to monitor a pressure with a certain range. Such an arrangement can also be used to monitor two related pressures, such as a warning pressure and a critical pressure.

While one embodiment has been shown and described, it will be understood that it is not intended to limit the disclosure, but rather it is intended to cover all modifications and alternate methods falling within the spirit and the scope of the invention as defined in the appended claims.

A pressure switch that is integrated into a circuit board has been shown and described. The pressure switch provides a low cost, easily manufactured, durable, simple-to-assemble device for detecting when an ambient pressure reaches a selected set point.

Having thus described the aforementioned invention, we claim:

1. A pressure switch responsive to an ambient air pressure, said pressure switch comprising:

an enclosure defining an internal volume and an upper opening, said enclosure having a plurality of surfaces including a bottom surface and at least one side surface, one of said plurality of surfaces being formed from a circuit board;

a diaphragm covering said upper opening, said diaphragm forming a fluid-tight seal with said enclosure; and a conductive member adapted to cooperate with said diaphragm to signal when the ambient air pressure reaches a set point, said set point defined by a position of said conductive member relative to said diaphragm at a selected ambient air pressure.

2. The pressure switch of claim 1 wherein said diaphragm is constructed of a flexible, conductive material.

3. The pressure switch of claim 2 wherein said flexible, conductive material is a spring-temper metal.

4. The pressure switch of claim 1 wherein said diaphragm has a top surface and a bottom surface, said diaphragm defining a plurality of concentric grooves on said top surface.

5. The pressure switch of claim 4 wherein said diaphragm further defines a plurality of concentric grooves on said bottom surface.

6. The pressure switch of claim 1 wherein said enclosure further defines a through opening adapted to receive said conductive member, said through opening having a diameter.

7. The pressure switch of claim 6 wherein said conductive member is a precision ball bearing having a diameter, said set point being defined by said through opening diameter and said precision ball bearing diameter.

8. The pressure switch of claim 1 wherein conductive member is an elongated member, said set point being defined by positioning said elongated member relative to said diaphragm while a reference pressure is applied to said diaphragm.

9. A pressure switch responsive to an ambient air pressure, said pressure switch comprising:

an enclosure defining an internal volume and an upper opening, said enclosure having a plurality of surfaces including a bottom surface and at least one side surface, wherein one of said plurality of surfaces is formed from a circuit board, said bottom surface defining a through opening;

a diaphragm covering said upper opening, said diaphragm forming a fluid-tight seal with said enclosure; and an electrically conductive member received in said through opening in a fluid-tight manner, said electrically conductive member cooperating with said diaphragm to make an electrical connection when the ambient air pressure reaches a set point, said set point defined by a position of said electrically conductive member in relation to said diaphragm.

10. The pressure switch of claim 9 wherein said electrically conductive member is a ball bearing, said through opening adapted to receive a ball bearing, said set point being selected by choosing a ball bearing of a given diameter.

11. The pressure switch of claim 9 wherein said electrically conductive member is a ball bearing, said through opening being adapted to receive said ball bearing, said set point being selected by varying a diameter of said through opening.

12. The pressure switch of claim 9 wherein said diaphragm defines a plurality of concentric grooves in a surface of diaphragm.

13. A pressure switch, said pressure switch comprising:

an enclosure integrated into a circuit board, said enclosure having an open end;

a diaphragm member adapted to flex in response to an ambient pressure, said diaphragm member covering said enclosure open end, said diaphragm member and said enclosure connected in a fluid-tight manner;

a set point opening defined by said enclosure, said set point opening located in a surface of said enclosure opposite said enclosure open end; and a conductive member received within said set point opening, said conductive member adapted to cooperate with said diaphragm member to signal when the ambient pressure reaches a set point.

14. The pressure switch of claim 13 wherein said set point opening, said conductive member, and said diaphragm cooperate to define said set point.

15. The pressure switch of claim 13 wherein said conductive member and said diaphragm cooperate to define said set point.

16. A pressure switch responsive to an ambient air pressure, said pressure switch comprising:

an enclosure defining an internal volume and an upper opening, said enclosure having a plurality of surfaces including a bottom surface and at least one side surface, one of said plurality of surfaces being formed from a circuit board;

a diaphragm covering said upper opening, said diaphragm forming a fluid-tight seal with said enclosure, said diaphragm having a top surface and a bottom surface, said diaphragm defining a plurality of concentric grooves on said top surface, said diaphragm further defining a plurality of concentric grooves on said bottom surface, wherein said plurality of concentric grooves on said bottom surface is offset from said plurality of concentric grooves on said top surface; and a conductive member adapted to cooperate with said diaphragm to signal when the ambient air pressure reaches a set point, said set point defined by a position of said conductive member relative to said diaphragm at a selected ambient air pressure.

17. A pressure switch responsive to an ambient air pressure, said pressure switch comprising:

an enclosure defining an internal volume and an upper opening, said enclosure having a plurality of surfaces including a bottom surface and at least one side surface, wherein one of said plurality of surfaces is formed from a circuit board, said bottom surface defining a through opening;

a diaphragm covering said upper opening, said diaphragm forming a fluid-tight seal with said enclosure, said diaphragm defining a first plurality of concentric grooves in a first surface and a second plurality of concentric grooves in an opposing surface, said second plurality of concentric grooves offset from said first plurality of concentric grooves; and an electrically conductive member received in said through opening in a fluid-tight manner, said electrically conductive member cooperating with said diaphragm to make an electrical connection when the ambient air pressure reaches a set point, said set point defined by a position of said electrically conductive member in relation to said diaphragm.

18. A pressure switch responsive to an ambient air pressure, said pressure switch comprising:

an enclosure defining an internal volume and an upper opening, said enclosure having a plurality of surfaces including a bottom surface and at least one side surface, wherein one of said plurality of surfaces is formed from a circuit board, said bottom surface defining a through opening, said enclosure defining an exchange opening allowing access to said internal volume, said exchange opening adapted to allow said internal volume to be filled with at least one fluid;

a diaphragm covering said upper opening, said diaphragm forming a fluid-tight seal with said enclosure; and an electrically conductive member received in said through opening in a fluid-tight manner, said electrically conductive member cooperating with said diaphragm to make an electrical connection when the ambient air pressure reaches a set point, said set point defined by a position of said electrically conductive member in relation to said diaphragm.

19. The pressure switch of claim 6 wherein said conductive member is a spherical member having a selected diameter, said set point being defined by said through opening diameter and said spherical member diameter.

20. The pressure switch of claim 9 wherein said electrically conductive member is a sphere, said through opening adapted to receive said sphere, said set point being selected by varying a diameter of said sphere.

21. The pressure switch of claim 9 wherein said electrically conductive member is a sphere, said through opening being adapted to receive said sphere, said set point being selected by varying a diameter of said through opening.

* * * * *